US009300069B2

(12) United States Patent
Morello et al.

(10) Patent No.: US 9,300,069 B2
(45) Date of Patent: Mar. 29, 2016

(54) ELECTRICAL TERMINAL WITH ENHANCED CLAMPING FORCE

(71) Applicant: DELPHI TECHNOLOGIES, INC., Troy, MI (US)

(72) Inventors: John R. Morello, Warren, OH (US); Jeffrey A. Janis, Warren, OH (US); James M. Rainey, Warren, OH (US); Scott Shemitz, Middlefield, OH (US)

(73) Assignee: Delphi Technologies, Inc., Troy, MI (US)

( * ) Notice: Subject to any disclaimer, the term of this patent is extended or adjusted under 35 U.S.C. 154(b) by 70 days.

(21) Appl. No.: 14/179,947

(22) Filed: Feb. 13, 2014

(65) Prior Publication Data

US 2015/0229056 A1 Aug. 13, 2015

(51) Int. Cl.

| | |
|---|---|
| ***H01R 13/15*** | (2006.01) |
| ***H01R 13/18*** | (2006.01) |
| *H01R 13/11* | (2006.01) |

(52) U.S. Cl.

CPC ..... *H01R 13/18* (2013.01); *H01R 13/113* (2013.01)

(58) Field of Classification Search

CPC ..... H01R 13/187; H01R 13/15; H01R 13/18
USPC ..... 439/839, 845, 847
See application file for complete search history.

(56) References Cited

U.S. PATENT DOCUMENTS

| | | | | |
|---|---|---|---|---|
| 4,537,462 | A | 8/1985 | Manabe | |
| 5,281,175 | A | 1/1994 | Chupak et al. | |
| 5,645,458 | A | 7/1997 | Hotea | |
| 7,892,050 | B2 * | 2/2011 | Pavlovic et al. | 439/839 |
| 8,366,497 | B2 | 2/2013 | Glick et al. | |
| 8,475,220 | B2 * | 7/2013 | Glick et al. | 439/839 |
| 8,992,270 | B2 * | 3/2015 | Glick et al. | 439/839 |
| 2007/0128907 | A1 | 6/2007 | Sakamoto et al. | |
| 2008/0064248 | A1 | 3/2008 | Huang | |
| 2011/0076901 | A1 | 3/2011 | Glick et al. | |
| 2013/0225016 | A1 | 8/2013 | Mulot et al. | |

FOREIGN PATENT DOCUMENTS

| | | | |
|---|---|---|---|
| JP | 2011159611 | A | 8/2011 |

OTHER PUBLICATIONS

International Search Report for International Patent Appl. No. PCT/US23015/015208, published May 22, 2015.

* cited by examiner

*Primary Examiner* — Phuong Dinh
(74) *Attorney, Agent, or Firm* — Robert J. Myers

(57) ABSTRACT

An electrical connector having one or more pairs of opposing contact arms extending from a body portion and configured to receive a mating connector. A spring clamp member is positioned over the opposing contact arms to increase a compressive force of the contact arms on the mating connector. The contact arms include stabilizing features to limit lateral, longitudinal, and/or rotational movement of the spring clamp member relative to the contact arms. The contact arms may be formed of a material having a high electrical connectivity and the spring clamp member may be formed of a different material having a higher relaxation temperature than the contact arm material. The mating connector may include be a male blade type terminal.

15 Claims, 5 Drawing Sheets

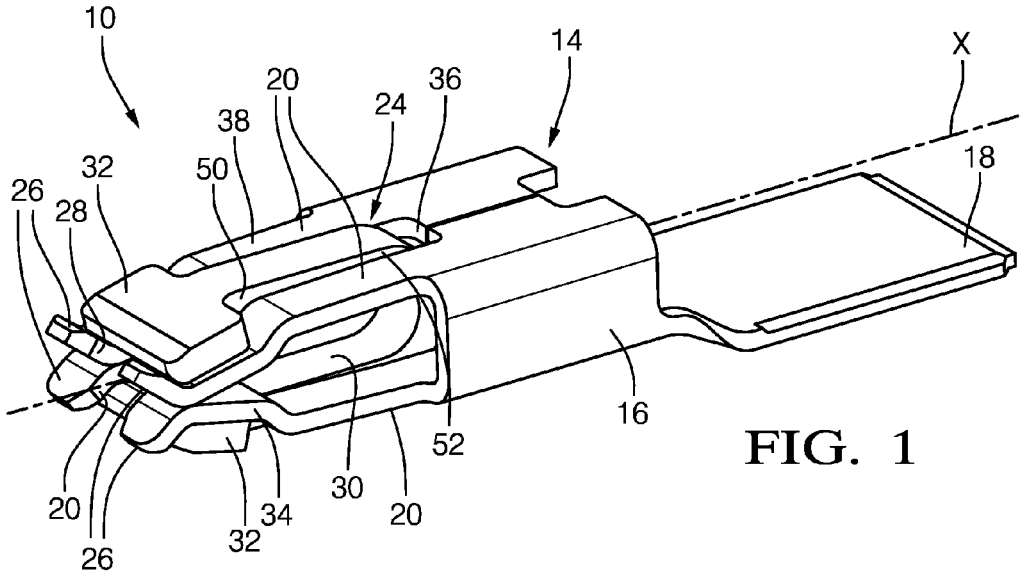
FIG. 1
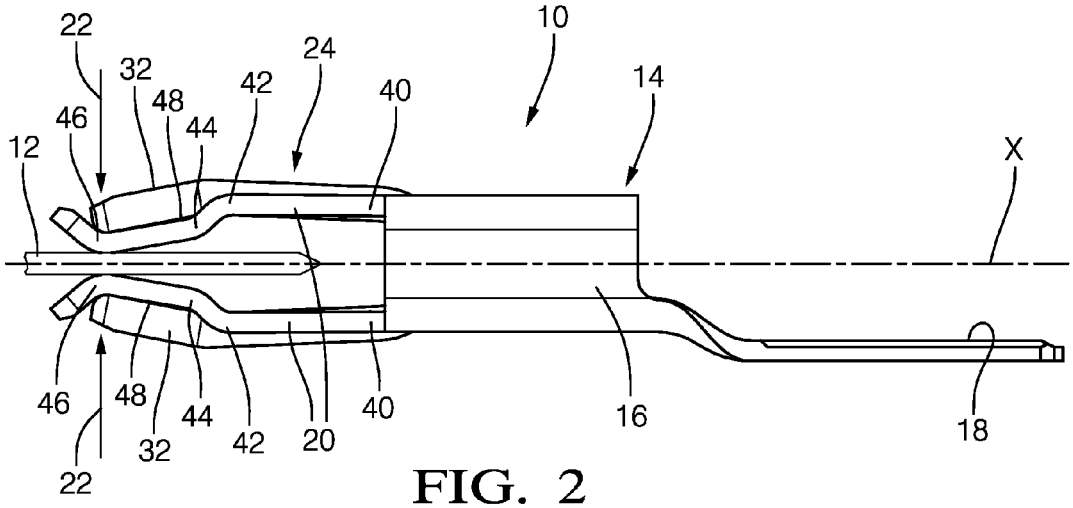
FIG. 2
| NORMAL FORCE (NEWTON) | CURRENT (AMPERE) |
|---|---|
| 5 | 150 |
| 10 | 180 |
| 15 | 200 |
| 20 | 201 |
FIG. 3

ELECTRICAL TERMINAL WITH ENHANCED CLAMPING FORCE

TECHNICAL FIELD OF THE INVENTION

The invention generally relates to an electrical terminal, and more particularly relates to a female electrical terminal configured to receive a mating male electrical terminal and to provide a high compressive clamping force against the male terminal.

BACKGROUND OF THE INVENTION

Terminals may be constructed from copper due to its beneficial electrical conductivity properties. Copper can be susceptible to relaxation (i.e., loss of spring force) as temperatures increase. Since temperature of the terminals can increase as the electrical current flowing through the terminal increases, copper terminals may have a reduced ability to maintain strong clamping force under such conditions. In the case of the copper terminal being a female terminal constructed to provide a compressive force, this relaxation of the female terminal can decrease an overall contact area with a mating male blade terminal, which may result in increased electrical resistance and a further increase in temperature. It is typically desirable to keep the overall size of an electrical distribution box or other connectors as small as possible while still providing the necessary current carrying capacity. Therefore, it may not be beneficial to increase compressive force by simply making the female terminal thicker or wider. When copper is used, the size limitations may make the desired spring force unattainable. Copper alloys for which relaxation does not occur until higher temperatures are reached have been used, but typically these alloys typically provide lower electrical conductivity.

A spring clamp member that is made from a material that is not as susceptible to temperature related relaxation, such a stainless steel, may be added to the female terminal. However, establishing and maintaining alignment between the contact arms of the terminal and the spring clamp member have been found to present challenges. One example of such a female terminal is shown in U.S. Pat. No. 8,475,220 issued on Jul. 2, 2013 to Glick et al. The terminal shown in the '220 patent includes tabs, described as lances, that are formed on the ends of the spring clamp member and inserted between the contact arms to align the spring clamp member to the contact arms and prevent lateral motion of the spring clamp member. These tabs require separate forming operations during the process of manufacturing of the spring clamp member.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, a female terminal assembly for an electrical connector configured to connect with a mating male terminal is provided. The female terminal assembly includes at least two pairs of opposing contact arms configured to receive the male terminal therebetween and each adjoining pair of opposing contact arms defining a recess therebetween and a spring clamp member having two opposing clamping portions in contact with the at least two pair of opposing contact arms and connected by a spring portion at least partially disposed with the recess. Each of the contact arms defines a stabilizing feature that is configured to limit lateral movement the spring clamp member along a lateral axis of the female terminal assembly. The mesial edges of the contact arms and distal edges of the spring portion may cooperate to limit movement of each of the clamping portions along a longitudinal axis of the female terminal assembly. A portion of a fixed end of each contact arm may be bent outwardly away the longitudinal axis of the female terminal assembly to form the stabilizing feature. Alternatively, the fixed end of each contact arm may be bent inwardly toward the longitudinal axis of the female terminal assembly to form the stabilizing feature. The spring portion of the spring clamp member may substantially define a U-shape. The two opposing clamping portions project laterally from the spring portion. The two opposing clamping portions do not define a tab distinct from the spring portion that is disposed within the recess between the contact arms.

Each of the contact arms may be formed of a first material and the spring clamp member may be formed from a second material, wherein the first material has a lower electrical resistance than the second material. The first material may have a lower relaxation temperature than the second material. The first material comprises a copper-based material and the second material comprises a ferrous-based material.

Each of the contact arms may extend in the same direction from a body portion, the body portion may define a cavity between opposed top and bottom sides spaced apart relative to opposed lateral sides, the contact arms connecting exclusively to the top and bottom sides. The female terminal assembly may include a terminal area having top and bottom terminals extending from the body portion for connection to a corresponding male terminal, the contact arms, body portion, top terminal and bottom terminal being formed from a single sheet of folded metal. The top terminal may be mechanically and electrically bonded to the bottom terminal with at least one of a clinch and a weld.

In another embodiment of the present invention, an electrical terminal assembly is provided. The electrical terminal assembly includes a plurality of blade shaped male terminals; and a plurality of female terminals configured to receive the male terminals. Each of female terminals have at least two pair of opposing contact arms configured to receive the male terminal therebetween and each adjoining pair of opposing contact arms defining a recess therebetween and a spring clamp member having two opposing clamping portions in contact with the at least two pair of opposing contact arms and connected by a spring portion at least partially disposed with the recess. Each of the contact arms defines a stabilizing feature configured to limit movement of each of the clamping portions along a longitudinal axis of the female terminal.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which:

FIG. 1 is perspective view of a female terminal assembly in accordance with a first embodiment;

FIG. 2 is side view of the female terminal assembly of FIG. 1 receiving a mating male terminal in accordance with the first embodiment;

FIG. 3 is a chart of a normal clamping force applied by the female terminal assembly to the male terminal and associated current carrying capability in accordance with one embodiment;

DETAILED DESCRIPTION OF THE INVENTION

Figure 4A:
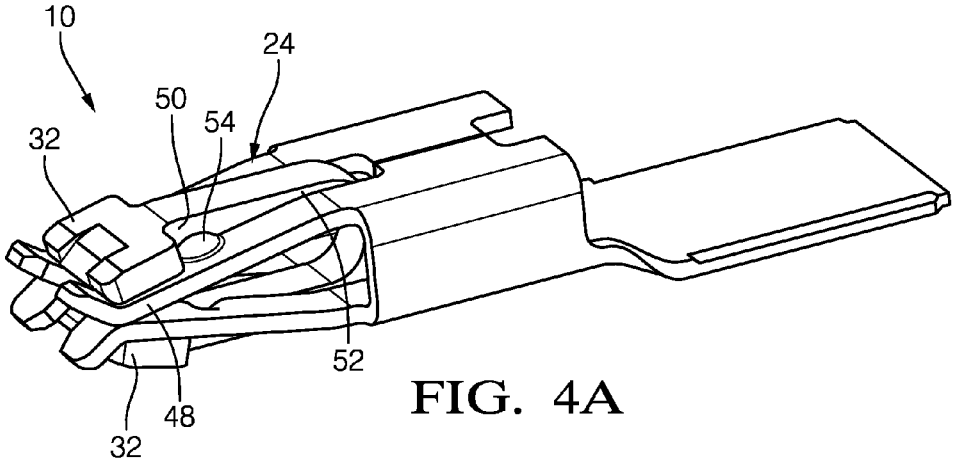
FIG. 4*a* is perspective view of a female terminal assembly in accordance with a second embodiment.

A female terminal assembly that is configured to receive a male blade terminal is presented herein. The assembly includes a pair of contact arms that receive the male terminal blade and a spring clamp member that compresses the contact arms to increase the clamping force of the contact arms against the male terminal.

FIG. 1 illustrates a non-limiting example of a female terminal assembly 10 for an electrical connector (not shown) that is configured to mate with a male blade type terminal 12 (see FIG. 2). The female terminal 14 has a body portion 16 formed with a termination portion 18 at one end that is designed to connect to the end of a wire cable (not shown), printed circuit board (not shown) or to another electrical conductor (not shown). The other end of the body portion 16 of the female terminal 14 forms a plurality of opposed contact arms 20 that are formed to receive and mate with the flat male blade type terminal 12. The female terminal 14 includes a first and second pair of opposed contact arms 20. As shown in FIG. 2, the contact arms 20 provide a compressive contact, or clamping, force 22 against the male terminal 12 when they are spread apart upon insertion of the male terminal 12 therebetween. The amount of clamping force 22 generated by the contact arms 20 may be increased by the addition of a spring clamp member 24 to the female terminal assembly 10. The free ends 26 of the contact arms 20 may be bent away, that is to say bent outwardly, from the longitudinal axis X of the female terminal 14 forming a receiving portion 28 to facilitate insertion of the male terminal 12 between the pairs of opposed contact arms 20. According to a non-limiting example, the U shaped spring clamp member 24 may be fitted within the female terminal 14 to provide stabilizing feature an additional compressive force to the contact arms 20, thus increasing the clamping force 22 of the contact arms 20 on the male terminal 12.

According to one non-limiting example, the spring clamp member 24 may include a U-shaped spring portion 30 and two opposed clamping portions 32 that extend laterally outward from the spring portion 30. The clamping portions 32 may extend to, or near to, the distal edges of the contact arms 20. The spring portion 30 of the spring clamp member 24 may be disposed within a recess 36 defined between the first and second pair of opposed contact arms 20. The clamping portions 32 of the spring clamp member 24 are disposed over the contact arms 20, that is to say, on an external surface 38 of the contact arms 20.

The spring clamp member 24 may be formed of a first material that is different from a second material forming the contact arms 20 of the female terminal 14 so that the first material has a higher relaxation temperature than the second material. This need not be the case as the spring clamp member 24 may be made of the same material as the contact arms 20. Alternatively, the spring clamp member 24 may be made of a non-conductive material. The first material may consist of a stainless steel such as SS301 which includes about 7% nickel, 10% carbon, 17% chromium, and the balance being iron. The second material may consist of any material having a high electrical conductivity and may consist of nearly pure copper (e.g. copper C102) or copper alloys (e.g. copper C151 which includes about 0.1% zirconium).

There are several factors to consider when designing the contact arms 20 and spring clamp member 24. A first factor is the insertion force required to insert the male terminal 12 between the contact arms 20 of the female terminal 14 due to the clamping force 22 applied by the contact arms 20 in addition to the force applied by the spring clamp member 24. It may be desirable to control the insertion force by selecting the desired material properties of the contact arms 20 and spring clamp member 24 or by selectively adjusting the dimensions (length, width, angles, etc.) of the contact arms 20 and spring clamp member 24 in order to meet ergonomic requirements for insertion force that may be imposed for a connector including the female terminal assembly 10. A second factor to consider is the clamping force 22 of the contact arms 20 against the male terminal 12 as it may be increase the clamping force 22 in order to maximize the current carrying capabilities of the connection between the female terminal assembly 10 and the male terminal 12 in order to support higher current (e.g. >80 amperes DC) and or higher voltage (e.g. >100 volts DC) applications.

The contact arms 20, for example, may be configured to provide about 4 newton (N) of normal force in the absence of the spring clamp member 24. Addition of the spring clamp member 24 may increase the normal (clamping) force 22 at the contact area to between about 12-15 N. These parameters may be selectively adjusted to achieve a balance between the amount of normal force and a rise over ambient temperature (ROA) of the connection between the male and female terminals for a given amount of current. The rise over ambient temperature may relate to an amount of current that may pass through the contact area between the beam pairs and male blade at a particular normal force before 55° C. ROA is achieved.

One non-limiting example of such a relationship may be found in the table shown in FIG. 3. As shown in the table, increases in normal force allow for corresponding increases in current prior to achieving 55° C. ROA. At some point, however, the rate of increase begins to slow, which is shown to occur around 15N (this transitional point may change significantly depending on materials and the configuration, shape, etc. of the contact point). The additional force applied by the spring clamp member 24 may be optimized) relative to the current carrying capabilities. The balancing of normal force versus current capabilities can be important as it may be desirable to use the least amount of normal force to meet current and ROA requirements while at the same time minimizing the amount of insertion force. Additionally, the surface roughness of the blade of the male terminal 12 and the contact arms 20 may be similarly controlled in order to reduce insertion force, such as by limiting the surface roughness. Double coining or other coining processes may be used to further refine the surface roughness of the blade of the male terminal 12 and contact arms 20.

As best illustrated in FIG. 2, the opposed contact arms 20 have fixed ends 40 that are attached to the body portion 16 of the female terminal 14. Stabilizing features are formed in the contact arms 20 to limit movement of the spring clamp member 24 relative to the female terminal 14. In this non-limiting example, the contact arms 20 have a compound bend in each contact arm 20 having a first bend 42 in a direction toward the longitudinal axis X of the female terminal 14 and a second bend 44 in a direction away from the longitudinal axis X. The first bend 42 and second bend 44 combine to form the stabilizing feature in this example. Each contact arm 20 also includes a third bend 46 near the free end of the contact arm 20 in a direction away from the longitudinal axis X that defines the receiving portion 28 of the contact arm 20. The portions of the contact arms 20 between the first bend 42 and the second bend 44 form valleys 48 into which the clamping portions 32 of spring clamp member 24 are received. The angle of the first bend 42 is greater than the angle of the second bend 44 so that the opposed contact arms 20 will make contact or at least approach one another.

As best shown in FIGS. 1 and 4*a*, the stabilizing features are in close proximity to the distal edges 34 of the spring portion 30 in a first region 50 and the mesial edges of the contact arms 20 are in close proximity to the distal edges 34 of the spring portion 30 in a second region 52. The stabilizing features, the mesial edges of the contact arms 20 and distal edges 34 of the spring portion 30 cooperate to limit lateral movement of the spring portion 30 and thereby limit lateral movement of the spring clamp member 24 along a lateral axis Y relative to the female terminal 14. The valleys 48 defined by the bends 42, 44, 46 in the free end of the contact arms 20 and the stabilizing features may also cooperate to capture the clamping portions 32 of the spring clamp member 24 and limit movement of the clamping portions 32 along the longitudinal axis X of the female terminal 14 and thus limit movement of the spring clamp member 24 relative to the female terminal 14 along the longitudinal axis X of the female terminal 14. The mesial edges of the contact arms 20 (the edges adjacent to the recess 36) may further cooperate with the distal edges 34 of the spring portion 30 of the spring clamp member 24 to limit lateral movement of the spring clamp member 24 along the lateral axis Y relative to the female terminal 14. The stabilizing features, the contact arms 20, and the spring portion 30 may also cooperate to limit rotational movement of the spring clamp member 24 relative to the contact arms 20 around the longitudinal axis of the female terminal 14.

Figure 4B:
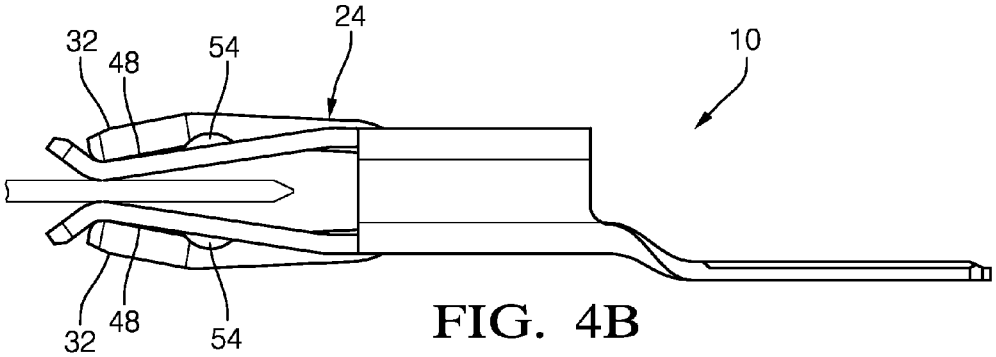
FIG. 4*b* is side view of the female terminal assembly of FIG. 4*a* receiving a mating male terminal in accordance with the second embodiment.
Figure 4C:
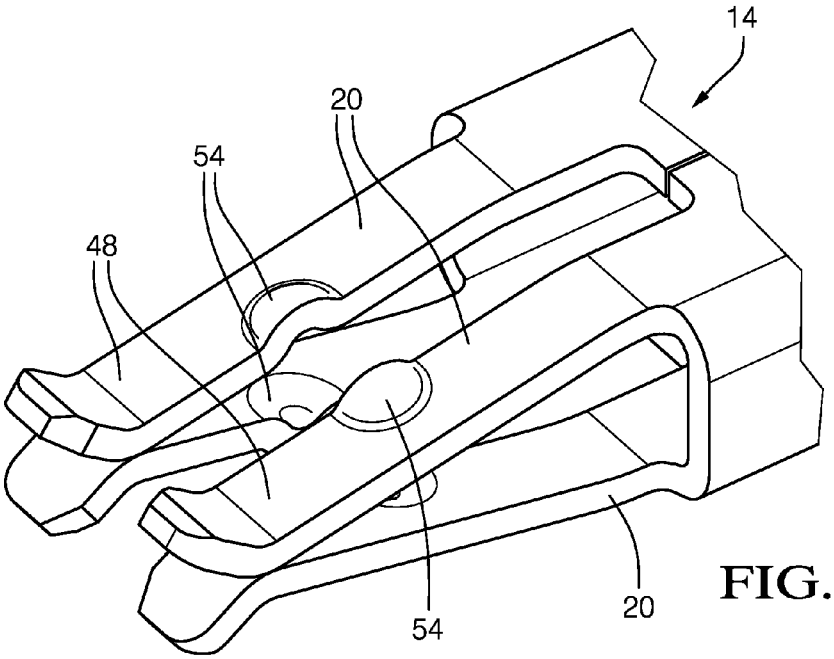
FIG. 4*c* is a perspective view of the female terminal of FIG. 4*a* in accordance with the second embodiment.
Figure 5A:
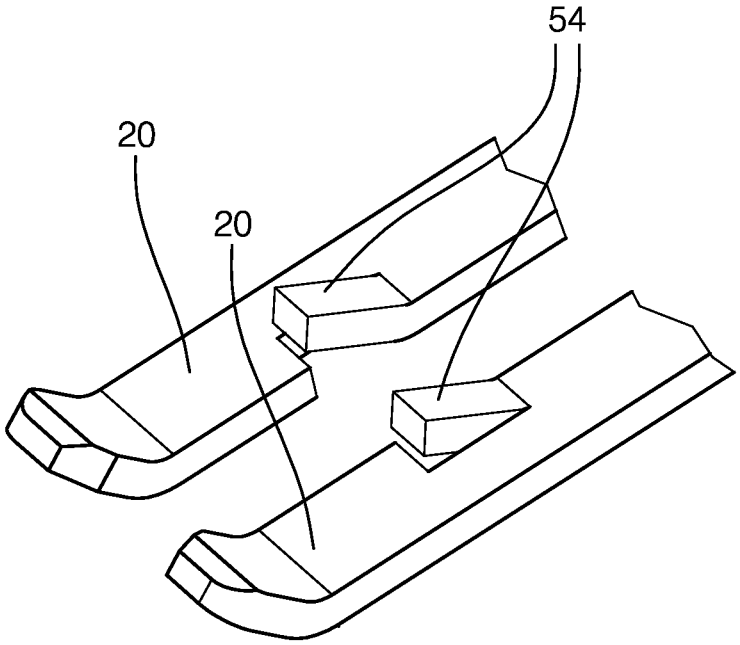
FIG. 5*a* is a perspective view of a female terminal in accordance with a third embodiment.
Figure 5B:
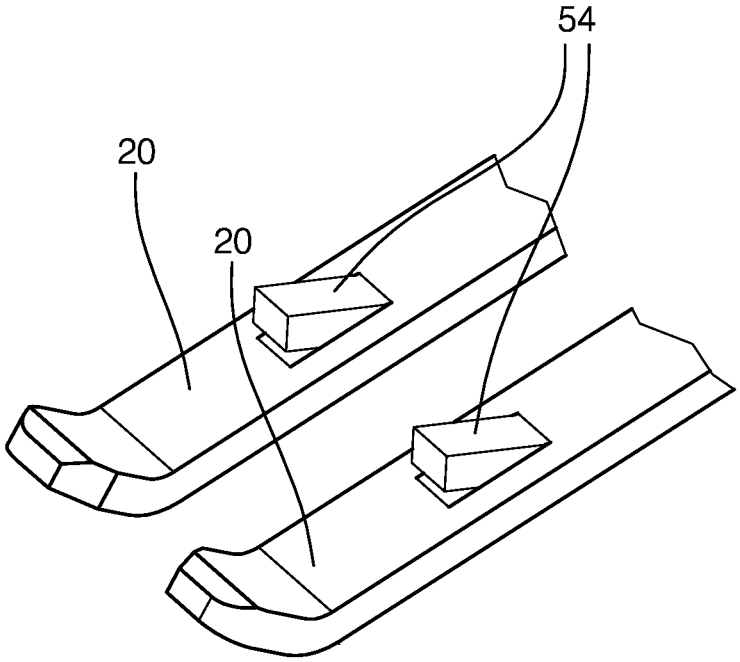
FIG. 5*b* is a perspective view of a female terminal in accordance with a fourth embodiment.
Figure 5C:
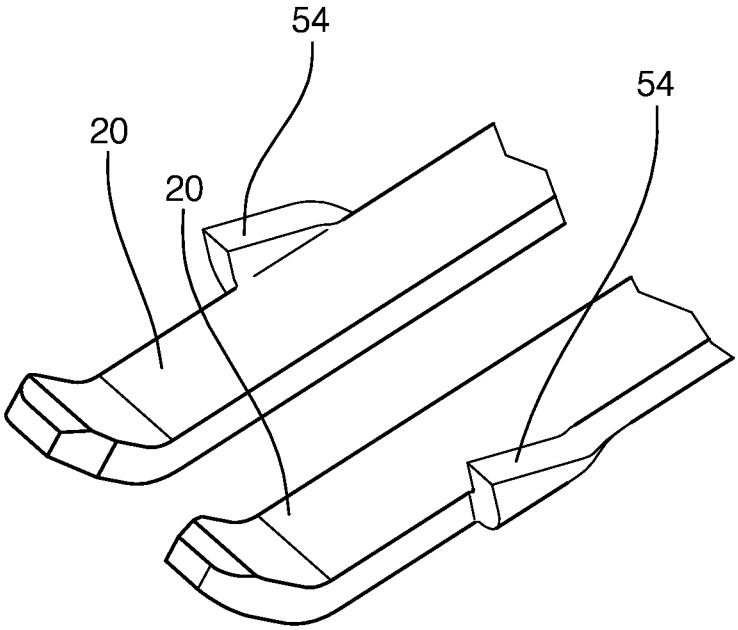
FIG. 5*c* is a perspective view of a female terminal in accordance with a fifth embodiment.
Figure 5D:
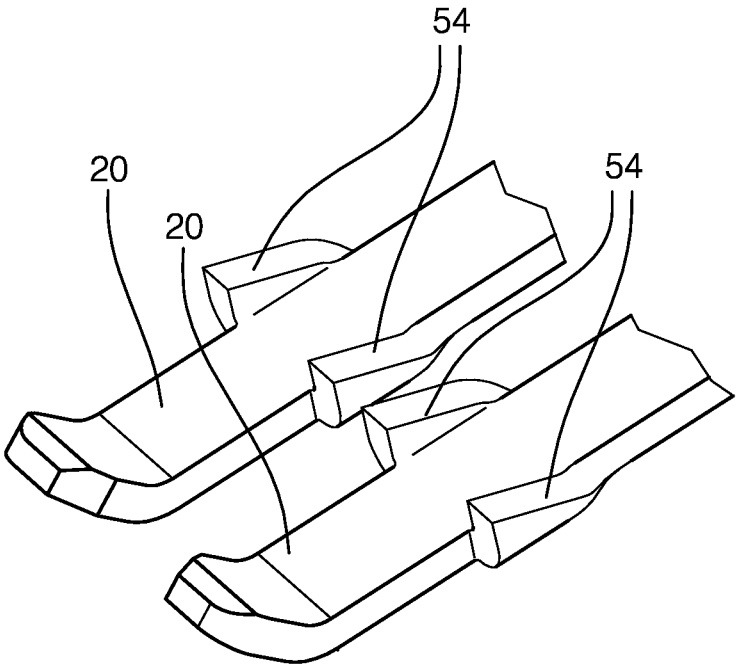
FIG. 5*d* is a perspective view of a female terminal in accordance with a sixth embodiment.

According to the non-limiting example illustrated in FIGS. 4*a*-4*c*, the stabilizing features may alternatively be a tab or protrusion 54 formed in the contact arms 20 forming valleys 48 between the receiving portions and the stabilizing features of the contact arms 20. The protrusions 54 shown in FIGS. 4*a*-4*c* may be formed by a embossing or punching process. FIGS. 5*a*-5*d* illustrate several more non limiting examples of stabilizing features formed by protrusions 54. The protrusions 54 shown in FIGS. 5*a* and 5*b* may be formed by a shearing and bending process. The protrusions 54 shown in FIGS. 5*c* and 5*d* may be formed by a folding process. The protrusion 54 may be formed in the distal edges and/or mesial edges of the contact arms 20. The protrusions 54 may alternatively be formed in the central portion of the contact arms 20.

The contact arms 20, body portion 16, and termination portion 18 may be made from the same piece of material. The material may include the same or varying thickness throughout (e.g., portions may be thicker or thinner to improve stability, to control forces, etc.). The material may be cut, stamped, embossed, sheared, or otherwise manipulated from a solid material shaped to include recesses, reliefs, apertures, and other formations necessary to facilitate folding, bending, or other manipulating required to convert the flat piece of material into the illustrated configuration. Opposed sides of the material may be folded toward each other such that a split or fold line is formed proximate the two sides once positioned to the illustrated configuration. Once the female terminal 14 is arranged into the illustrated shape, the spring portion 30 of the spring clamp member 24 may be positioned within the recess 36 using an arbor or other device to open the contact arms 20 a distance which allows the rearward, closed end of the spring portion 30 to slide within the recess 36 a distance sufficient to allow the clamping portions 32 of the spring clamp member 24 to pass over the free ends 26 of the contact arms 20 such that the clamping portions 32 come to rest in the plurality of valleys 48 formed between the ends of the contact arms 20 and stabilizing features defined by the contact arms 20.

The termination portion 18 of the female terminal 14 illustrated in FIGS. 1, 2, 4*a*, and 4*b* is best suited for attachment of a wire cable by a welding process, such as sonic welding. However, alternative embodiments of the female terminal 14 may include a termination portion suited for crimping to a wire cable having a crushable tubular section in which the wire cable is inserted or wings that are wrapped about and crushed onto the wire cable (not shown). The termination portion may alternatively include a ring shaped feature that can be attached to an electrical conductor via a threaded fastener or rivet (not shown). Still alternatively, the termination portion may include features to facilitate mounting/attaching the female terminal 14 directly to a printed circuit board, such as by using a straight leg stamped terminal body that allows the legs to be attached to the printed circuit board via a soldering process (not shown).

Figure 6:
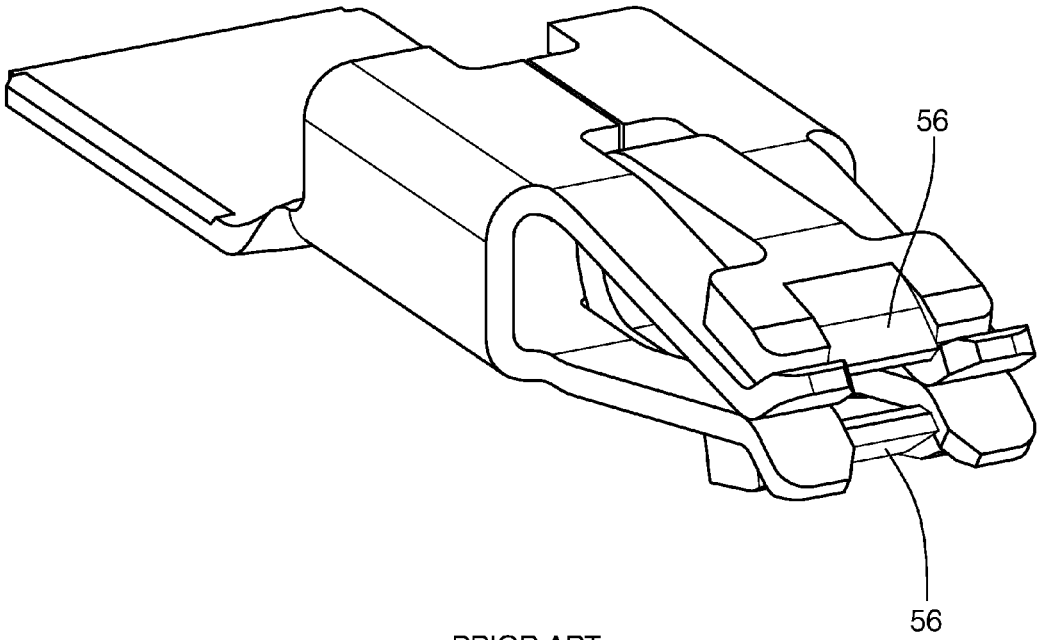
PRIOR ART FIG. 6
FIG. 6 is a perspective view of a female terminal assembly including a spring clamp member that defines a lance in accordance with the prior art.

The spring clamp member 24 does not include tab or lance features 56 that extend from the ends of the clamping portion 32 of the spring clamp member 24 and extend into the recess 36 between the opposing pairs of contact arms 20 as disclosed in the '220 patent, shown in FIG. 6, and described in the Background of the Invention. In contrast to the spring clamp member of '220, the spring clamp member 24 of the female terminal assembly 10 is aligned within the female terminal 14 by the stabilizing features formed in the contact arms 20, eliminating the need for forming a tab or lance feature in the spring clamp member 24. This provides the benefit of eliminating the process of forming the tab or lance feature in the material of spring clamp member 24 which may be more difficult to form than forming the stabilizing features in the contact arms 20, especially if the spring clamp member 24 is made from stainless steel and the contact arms 20 are formed of a copper based material.

Accordingly, a female terminal assembly 10 is provided. The female terminal assembly 10 may include a female terminal 14 and a spring clamp member 24 assembled together. One end of the female terminal 14 may include multiple contact arms 20 made of highly conductive alloy (for example C151, C102, or similar). The other end of the female terminal 14 may include a termination portion 18 that is designed to be connected to a wire cable. Alternatively, the termination portion may include features to facilitate mounting the terminal directly to a printed board. The spring clamp member 24 can be made of an alloy with high springiness (e.g., stainless steel 301). The spring clamp member 24 may include clamping portions 32 that contact opposite sides of a pair of opposed contact arms 20. The spring clamp member 24 may be configured to provide high normal force, in particular with respect to high temperature situations with wire cables that are mechanically and/or electrically connected to the terminal to provide maximum current surface and maximum current carrying capacity in high temperature environments. The wire cables can be attached to the terminal by welding, crimping or other operations. The wires can be welded to the terminal in multiple directions and can have strands split and welded to each side of the terminal. Also, a bus bar can be used instead of the wire strands and can be attached to the terminal by solder, rivet, or threaded fastener. The spring clamp member 24 may be made of stainless steel which has low relaxation properties at elevated temperatures. As a result, the spring clamp member 24 may prevent the respective contact arms 20 from relaxing at elevated temperatures which would otherwise reduce the contact area with an associated male blade terminal. As a result, the need for utilizing a copper alloy or similar substitute of material with lesser conductive properties is not necessary since relaxation has been minimized.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A female terminal assembly for an electrical connector configured to connect with a mating male terminal, said assembly comprising:

at least two pair of opposing contact arms configured to receive said male terminal therebetween and each adjoining pair of opposing contact arms defining a recess therebetween; and a spring clamp member having two opposing clamping portions in contact with the at least two pair of opposing contact arms and connected by a spring portion, said spring clamp member at least partially disposed with the recess, wherein each of the contact arms define a compound bend intermediate a free end and a fixed end, said compound bend having a first bend in a direction toward a longitudinal axis of the female terminal assembly and a second bend in a direction away from the longitudinal axis, wherein the compound bends cooperate to limit lateral movement of the clamping portions of the spring clamp member within the recess along a lateral axis of the female terminal assembly and wherein each contact arm further defines a third bend proximate the free end in a direction away from the longitudinal axis configured to form a receiving portion of the female terminal assembly.

2. The female terminal assembly in accordance with claim 1, wherein mesial edges of the contact arms and distal edges of the spring portion cooperate to limit lateral movement of the clamping portions of the spring clamp member along the lateral axis of the female terminal assembly.

3. The female terminal assembly in accordance with claim 1, wherein the spring portion substantially defines a U-shape.

4. The female terminal assembly in accordance with claim 1, wherein the two opposing clamping portions project laterally from the spring portion.

5. The female terminal assembly in accordance with claim 2, wherein the two opposing clamping portions do not define a tab distinct from the spring portion that is disposed within the recess.

6. The female terminal assembly in accordance with claim 1, wherein each of the contact arms are formed of a first material and the spring clamp member is formed from a second material, wherein the first material has a lower electrical resistance than the second material.

7. The female terminal assembly in accordance with claim 6, wherein the first material has a lower relaxation temperature than the second material.

8. The female terminal assembly in accordance with claim 6, wherein the first material comprises a copper-based material and the second material comprises a ferrous-based material.

9. The female terminal assembly in accordance with claim 1, wherein each of the contact arms extend in the same direction from a body portion, the body portion defining a cavity between opposed top and bottom sides spaced apart relative to opposed lateral sides, the contact arms connecting exclusively to the top and bottom sides.

10. The female terminal assembly in accordance with claim 9, further comprising a terminal area having top and bottom terminals extending from the body portion for connection to a corresponding male terminal, the contact arms, body portion, top terminal and bottom terminal being formed from a single sheet of folded metal.

11. The female terminal assembly in accordance with claim 10, wherein the top terminal is mechanically and electrically bonded to the bottom terminal with at least one of a clinch and a weld.

12. The female terminal assembly in accordance with claim 1, wherein the third bend is distinct from the compound bend.

13. The female terminal assembly in accordance with claim 1, wherein an angle of the first bend is greater than an angle of the second bend so that the opposed contact arms will at least approach one another.

14. The female terminal assembly in accordance with claim 1, wherein the compound bend is intermediate the fixed end and the third bend of each contact arm.

15. An electrical terminal assembly, comprising:

a plurality of blade shaped male terminals; and a plurality of female terminals configured to receive the male terminals, said plurality of female terminals each having, at least two pair of opposing contact arms configured to receive said male terminal therebetween and each adjoining pair of opposing contact arms defining a recess therebetween, and a spring clamp member having two opposing clamping portions in contact with the at least two pair of opposing contact arms and connected by a spring portion at least partially disposed with the recess, wherein each of the contact arms define a compound bend intermediate a free end and a fixed end, said compound bend having a first bend in a direction toward a longitudinal axis of the female terminal and a second bend in a direction away from the longitudinal axis, wherein the compound bends cooperate to limit lateral movement of the spring clamp member within the recess along a lateral axis of the female terminal and wherein each contact arm further defines a third bend proximate the free end in a direction away from the longitudinal axis configured to form a receiving portion of the female terminal.

* * * * *